US008912726B2

(12) United States Patent
Lee et al.

(10) Patent No.: US 8,912,726 B2
(45) Date of Patent: Dec. 16, 2014

(54) LIGHT EMITTING DEVICE

(71) Applicant: Samsung Electronics Co., Ltd., Gyeonggi-do, Suwon-si (KR)

(72) Inventors: Jong Ho Lee, Suwon-si (KR); Sung Tae Kim, Suwon-si (KR); Chan Mook Lim, Suwon-si (KR); Jin Hwan Kim, Suwon-si (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 13/789,601

(22) Filed: Mar. 7, 2013

(65) Prior Publication Data

US 2013/0234611 A1 Sep. 12, 2013

(30) Foreign Application Priority Data

Mar. 9, 2012 (KR) ..... 10-2012-0024413

(51) Int. Cl.
*H05B 37/02* (2006.01)
*H05B 33/08* (2006.01)

(52) U.S. Cl.
CPC ..... *H05B 33/083* (2013.01); *H05B 33/0809* (2013.01); *H05B 33/0821* (2013.01)
USPC ..... 315/185 R; 315/192; 315/196; 315/224; 315/291; 315/294

(58) Field of Classification Search
USPC ..... 315/185 R, 185 S, 192, 209 R, 210, 224, 315/291, 294, 308, 312
See application file for complete search history.

(56) References Cited

U.S. PATENT DOCUMENTS

| | | | | |
|---|---|---|---|---|
| 7,902,770 | B2 * | 3/2011 | Shakuda | 315/291 |
| 2007/0216322 | A1 * | 9/2007 | Kim | 315/312 |
| 2008/0054814 | A1 * | 3/2008 | Deppe et al. | 315/192 |
| 2011/0031891 | A1 * | 2/2011 | Lee et al. | 315/250 |
| 2011/0291582 | A1 * | 12/2011 | Wei et al. | 315/254 |
| 2011/0316439 | A1 * | 12/2011 | Lin et al. | 315/250 |

FOREIGN PATENT DOCUMENTS

| | | | |
|---|---|---|---|
| JP | 2003017279 | A | 1/2003 |
| KR | 20080030349 | A | 4/2008 |
| KR | 100911774 | B1 | 8/2009 |
| KR | 101021238 | B1 | 3/2011 |
| WO | 2007001116 | A | 1/2007 |

* cited by examiner

*Primary Examiner* — Douglas W Owens
*Assistant Examiner* — Thai Pham
(74) *Attorney, Agent, or Firm* — Renaissance IP Law Group LLP

(57) ABSTRACT

Light emitting devices. A light emitting device including a power source; and a plurality of light emitting diode (LED) arrays coupled to the power source unit; and at least one delay unit. Each delay unit is coupled to a corresponding light emitting diode array of the light emitting diode arrays.

12 Claims, 3 Drawing Sheets

LIGHT EMITTING DEVICE

CROSS-REFERENCE TO RELATED APPLICATIONS

This application claims the priority of Korean Patent Application No. 10-2012-0024413 filed on Mar. 9, 2012, in the Korean Intellectual Property Office, the disclosure of which is incorporated herein by reference.

BACKGROUND

1. Technical Field

The present disclosure relates to a light emitting device.

2. Description of the Related Art

A semiconductor light emitting diode (LED), having advantages as a light source in terms of output, efficiency, and reliability, has been actively researched and developed as a high output, high efficiency light source that may replace a backlight of illumination devices or display devices.

In general, an LED is driven at a relatively low DC current. Thus, in order to drive an LED with a normal voltage mode (e.g., AC 220V), an additional circuit (e.g., an AC/DC converter) supplying a low DC output voltage is required. However, the introduction of an additional circuit makes a configuration of an LED module complicated and degrades efficiency and reliability due to a process of converting supplied power. In addition, product unit costs are increased due to the additional components besides a light source, the size of a product is increased, and EMI characteristics are degraded due to a periodic component related to a switching mode operation.

In an effort to solve the problems, various types of LED driving circuits have been proposed that may be driven even at an AC voltage without an additional converter. However, an LED has diode characteristics, so it is difficult for only a single LED to be driven with bi-directional AC. Thus, the single LED may be protected by a Zener diode, which is, however, ineffective in size, capacity, and cost in terms of a system, and flicker characteristics may be degraded in unidirectional 60 Hz driving to cause a problem with light quality. In addition, when high voltage AC power is used, a single LED having a driving voltage Vf of about 3~4V has limitations in effective driving. Thus, in order to make an AC driving LED, a high voltage LED operable bi-directionally at 120 Hz and having a high driving voltage Vf is required.

SUMMARY

An embodiment includes a light emitting device comprising: a power source; a plurality of light emitting diode (LED) arrays coupled to the power source unit; and at least one delay unit. Each delay unit is coupled to a corresponding LED array of the LED arrays.

Another embodiment includes a light emitting device, comprising: a power source; a plurality of light emitting diode (LED) arrays, each LED array including a plurality of LEDs; at least one delay unit, each delay unit coupled to a corresponding LED array; and a driver integrated circuit coupled between the power source and the LED arrays.

Another embodiment includes a method comprising: supplying current signals to drive a plurality of light emitting diode (LED) arrays; and delaying at least one of the current signals.

In this case, wherein delaying the at least one of the current signals comprises delaying all but one of the current signals Also, wherein delaying the at least one of the current signals comprises delaying the current signals such that the current signals are substantially uniformly distributed in time.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION

Figure 1:
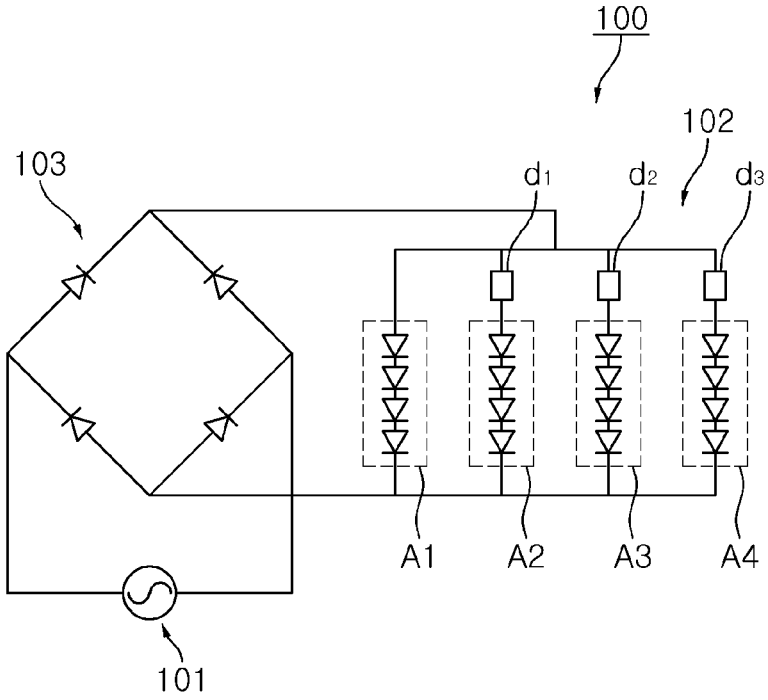
FIG. 1 is a schematic equivalent circuit diagram of a light emitting device according to an embodiment.

Embodiments of the present disclosure will now be described in detail with reference to the accompanying drawings.

The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art. In the drawings, the shapes and dimensions of elements may be exaggerated for clarity, and the same reference numerals will be used throughout to designate the same or like components.

Figure 2:
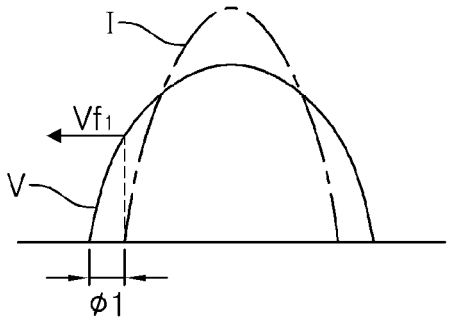
FIG. 2 is a view illustrating an example of driving a light emitting diode with AC power through voltage and current waveforms.
Figure 3:
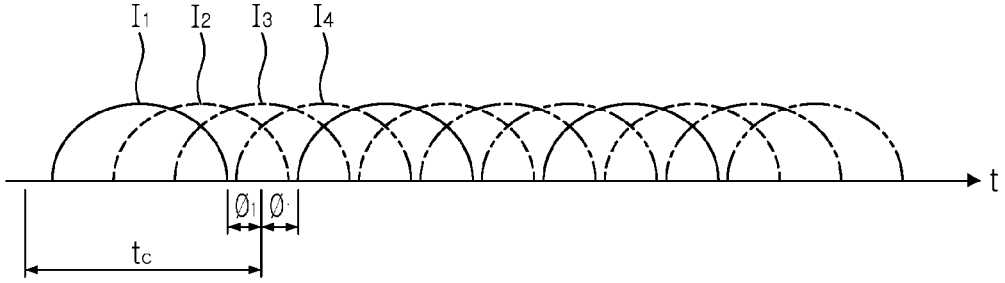
FIG. 3 is a view illustrating current waveforms in the example of driving of a light emitting device according to an embodiment of the present disclosure of FIG. 1.
Figure 4:
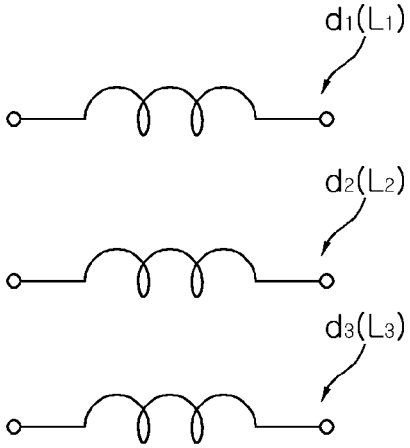
FIG. 4 is a view illustrating examples of delay units that may be used in the embodiment of FIG. 1.

FIG. 1 is a schematic equivalent circuit diagram of a light emitting device according to an embodiment. FIG. 2 is a view illustrating an example of driving a light emitting diode with AC power through voltage and current waveforms. FIG. 3 is a view illustrating current waveforms in the example of driving of a light emitting device according to an embodiment of the present disclosure of FIG. 1. FIG. 4 is a view illustrating examples of delay units that may be used in the embodiment of FIG. 1.

Referring to FIG. 1, in an embodiment, a light emitting device 100 includes power source units 101 and 103 and a light emitting unit 102. In particular, the light emitting unit 102 includes a plurality of light emitting diode (LED) arrays A1 to A4, and each of the LED arrays A1 to A4 includes one or more LEDs. In this embodiment, each of the LED arrays A1 to A4 includes four LEDs, but the number of LEDs may vary according to a magnitude of applied voltage, a required quantity of light, an LED driving voltage, and the like. Also, in this embodiment, four LED arrays A1 to A4 are provided, but the number of arrays may be fewer or greater than 4. In addition, the LED arrays A1 to A4 may each have the same number of LEDs, so they may emit light when the same level of voltage is applied thereto. However, in other embodiments, one or more of LED arrays A1 to A4 may have a different number of LEDs than the other LED arrays.

The LED arrays A1 to A4 are connected in parallel to both ends of the power source units. The power source units may include an AC power 101 and a rectifying unit 103 connected to both ends of the AC power source 101 to supply a rectified current signal to respective LED arrays among the plurality of LED arrays A1 to A4. However, in other embodiments the rectifying unit 103 may be omitted, and the AC power source 101 may be directly connected to the LED arrays A1 to A4 according to circumstances.

In an embodiment, at least one of the LED arrays A1 to A4 may be coupled to a delay unit d. In this embodiment, LED arrays A2 to A4 are coupled to delay units $d_1$, $d_2$, and $d_3$, respectively. However, in this embodiment, the first LED array A1 does not have a delay unit d. As can be seen from FIG. 1, the delay units $d_1$, $d_2$, and $d_3$ are connected in series to the LEDs, and light emission of the LEDs included in the LED arrays A2 to A4 having the delay units $d_1$, $d_2$, and $d_3$ is delayed in comparison to light emission of the LEDs included in the LED array A1 that does not have a delay unit. Namely, in the case of the LEDs included in the LED arrays A2 to A4 having the delay units $d_1$, $d_2$, and $d_3$, current signals are relatively delayed so waveforms of the current signals are shifted in time to the right, as shown in FIG. 3.

In order to delay light emission, as illustrated in FIG. 4, the delay units $d_1$, $d_2$, and $d_3$ may have an inductor, respectively, and the respective inductors may have different inductances $L_1$, $L_2$, and $L_3$ so that a time at which light emission occurs in the respective LED arrays A1 to A4, namely, a time at which the magnitude of a current becomes larger than substantially 0, may differ. In this case, the delay units $d_1$, $d_2$, and $d_3$ may use a different element having the same function, other than an inductor, but the use of an inductor simplifies a circuit configuration and ensures that a delay function is effectively performed.

An effect obtained by connecting the delay units $d_1$, $d_2$, and $d_3$ including inductors having different characteristics to the LED arrays A1 to A4 as described above will be described. First, referring to FIG. 2, a driving voltage $Vf_1$ of each of the LED arrays A1 to A4 has a value obtained by adding all the driving voltages of the LEDs included therein, and when an applied voltage is equal to or higher than the driving voltage $Vf_1$, a current signal I is generated to allow for light emission. Thus, with an AC voltage, a phase difference $\phi_1$ is made between the voltage V and the current I, namely, a duration of time during which light emission does not substantially take place is generated, resulting in the occurrence of a flicker phenomenon in the light emitting device.

In this embodiment, such a flicker phenomenon is alleviated by adjusting points in time of light emission of the LED arrays A1 to A4. Namely, in this embodiment, the LED arrays A1 to A4 are configured to emit light at different points in time according to the respective current waveforms $I_1$ to $I_4$ of the LED arrays A1 to A4 illustrated in FIG. 3. In this manner, since the respective LED arrays A1 to A4 start to emit light at different points in time, a duration of time during which light emission does not substantially take place may be reduced or eliminated in the light emitting device on the whole, thus lessening a flicker phenomenon. In this case, in order to lessen the flicker phenomenon, a delay time of light emission of each of the LED arrays A1 to A4 may be effectively adjusted so that at least one of the current waveforms $I_1$ to $I_4$ substantially overlaps in time with regions of the other current waveforms $I_1$ to $I_4$ when those current waveforms are substantially zero. For example, as illustrated in FIG. 3, current waveforms $I_2$ to $I_4$ overlap a region of current waveform $I_1$ that is $2\times\phi_1$ wide where the current is substantially zero. In an embodiment, a delay time introduced by the delay units $d_1$, $d_2$, and $d_3$ may be shorter than a cycle time $t_c$ of a voltage signal that flows through the LED arrays, specifically, a single driving time of the LED arrays which are periodically driven. In an embodiment, the current waveforms can be substantially uniformly distributed in time. As a result, LEDs of at least one LED array may be substantially turned on, reducing flickering.

In an embodiment, when using four LED arrays A1 to A4, a delay unit d is not coupled to the first LED array A1 while the delay units $d_1$, $d_2$, and $d_3$ may be configured by sequentially connecting inductors having a higher inductance to the other remaining second to fourth LED arrays A2 to A4. Here, in order to reduce the number of delay units d used in a light emitting device, the delay units d may be configured as described above, but in another embodiment, a delay unit d may also be connected to the first LED array A1 as desired, to form a configuration in which delay units are provided in all the LED arrays A1 to A4.

Figure 5:
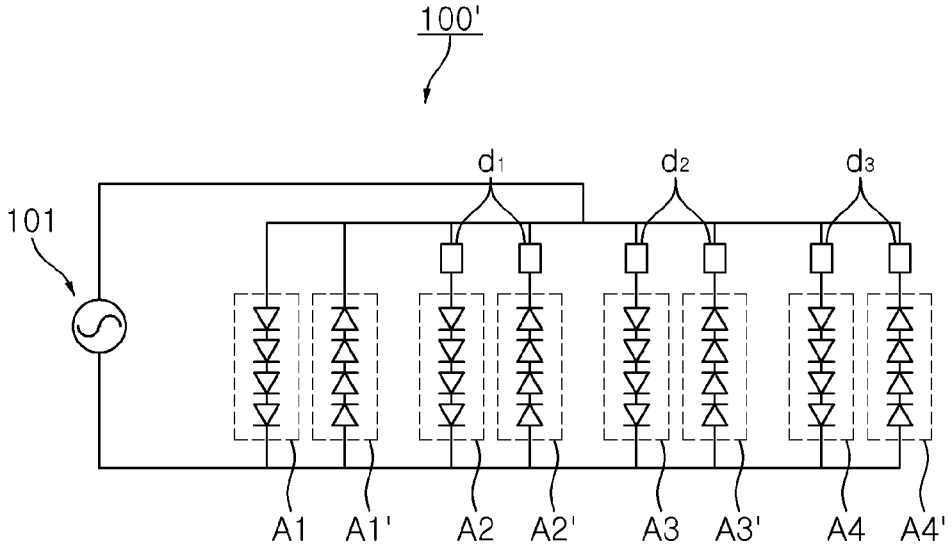
FIG. 5 is a schematic equivalent circuit diagram of a light emitting device according to another embodiment.

In this embodiment, the power source unit includes the rectifying unit 103. However, in another embodiment, the rectifying unit 103 may be excluded. FIG. 5 is a schematic equivalent circuit diagram of a light emitting device according to another embodiment. Referring to FIG. 5, a light emitting device 100' includes a structure in which LED arrays A1 to A4 and A1' to A4' are configured to receive unrectified AC power from the AC power source 101. In this embodiment, the LED arrays A1 to A4 include LEDs disposed in the mutually opposing directions with respect to corresponding LED array A1' to A4'. Accordingly, light may be emitted by voltages from the AC power source 101 in both directions. Namely, the LED arrays A1 to A4 arranged in the same direction may emit light by a voltage in one direction, and the LED arrays A1' to A4' arranged in the opposite direction may emit light by a voltage in the opposite direction. In this embodiment, delay elements $d_1$ to $d_3$ are coupled to the LED arrays A1 to A4 and A1' to A4'.

Here, each corresponding pair of LED arrays, such as LED arrays A2 and A2', may be coupled to a substantially similar delay element d, such as delay element $d_1$. Accordingly, as described above, each the current waveforms for LED arrays A1 to A4 may be delayed relative to each other during a first half-cycle of the AC power source 101 and the current waveforms for the LED arrays A1' to A4' may be similarity delayed relative to each other during a second half-cycle of the AC power source 101.

Although a single phase power source has been used as an example of an AC power source 101, multi-phase power sources can be used. For example, a three-phase power source may be used with LED arrays such as those described above disposed to be powered by one of more of the phases.

Figure 6:
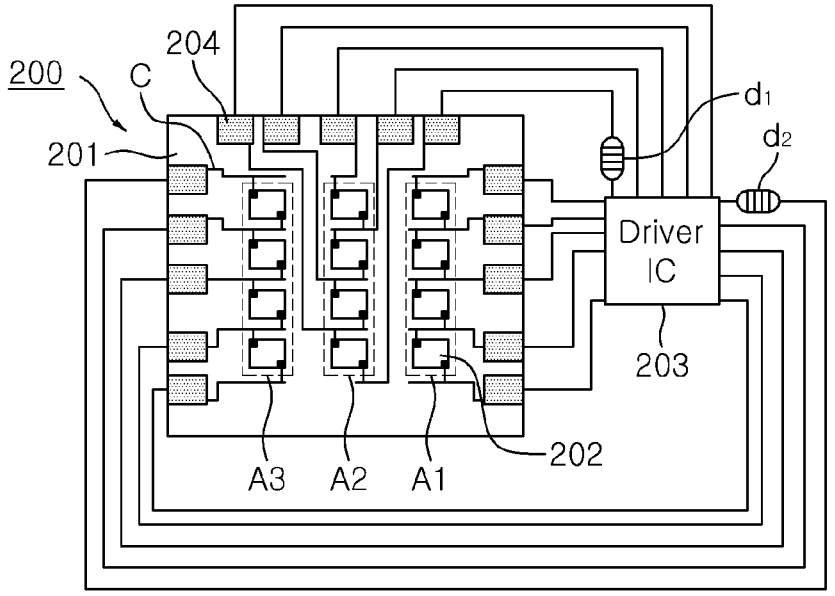
FIG. 6 is a plan view schematically illustrating a light emitting device according to another embodiment.

FIG. 6 is a plan view schematically illustrating a light emitting device according to another embodiment. The embodiment of FIG. 6 includes a light emitting device 200 and a driver integrated circuit (IC) 203, depicting an example of an LED wiring scheme. Here, a power source unit is not illustrated, and the power source unit provided in the foregoing embodiments may appropriately be used.

The light emitting device 200 includes a plurality of LEDs 202 disposed on a substrate 201. The LEDs 202 form a plurality of arrays A. In this embodiment, the arrays A include LED arrays A1 to A3. Each LED array A1 to A3 may include one or more LEDs 202. The driver IC 203 is coupled to both ends of respective LED arrays A1 to A3.

In this embodiment, electrode patterns 204 and connection lines C may be provided to electrically connect the driver IC 203 and the LEDs 202. As illustrated in FIG. 6, by configuring the electrode patterns 204 and the connection lines C, the driver IC 203 may individually drive the LEDs 202 provided in the respective LED arrays A1 to A3, and the addition of the driver IC 203 to the light emitting device 200 can further enhance a power factor, total harmonic distribution (THD), energy efficiency, and the like.

As described above, delay units d may be coupled to the LED arrays. Here, delay units $d_1$ and $d_2$ are coupled to LED arrays A2 and A3, respectively. The delay units $d_1$ and $d_2$ may include inductors that may have different levels of inductance. Thus, as described above, a length of time light is emitted from the light emitting device 200 may be increased and a flicker phenomenon may be reduced.

An embodiment provides a light emitting device having improved flicker characteristics when driven by an AC voltage.

According to an embodiment, there is provided a light emitting device including: a power source unit; and a plurality of light emitting diode (LED) arrays connected in parallel to both ends of the power source unit and having an array structure in which one or more LEDs are connected in series, wherein at least one of the plurality of LED arrays has a delay unit including an inductor connected in series to the one or more LEDs connected in series therein.

At least two of the plurality of LED arrays may have delay units, and inductors included in the delay units may have different inductance. In this case, at least one of the plurality of LED arrays may not have a delay unit.

At least one of the plurality of LED arrays may not have a delay unit.

The plurality of LED arrays may have the same number of LEDs included therein.

The power source unit may include an AC power source and a rectifying unit connected to both ends of the AC power source to supply a rectified current signal to respective LED arrays among the plurality thereof.

The power source unit may include an AC power source connected to both ends of respective LED arrays among the plurality thereof, and at least two of the plurality of LED arrays may include LEDs disposed in the mutually opposing directions with respect to the AC power source.

At least two of the LED arrays in which LEDs are disposed in the mutually opposing directions may include inductors having the same inductance.

An inductor delay time may be shorter than a cycle of a current signal flowing through the LED arrays.

The inductor delay time may be shorter than a single period of driving time of the LED arrays which are periodically driven by the power source unit.

The power source unit may include a driver integrated circuit (IC) connected to both ends of respective LED arrays.

The driver IC may individually drive the LEDs provided in respective LED arrays among the plurality thereof.

As set forth above, according to embodiments of the disclosure, a light emitting device having an improved flicker characteristics under an AC voltage can be obtained.

While the present disclosure has been shown and described in connection with the embodiments, it will be apparent to those skilled in the art that modifications and variations can be made without departing from the spirit and scope of the disclosure as defined by the appended claims.

What is claimed is:

1. A light emitting device comprising:

a power source;

a plurality of light emitting diode (LED) arrays coupled to the power source; and a plurality of delay units, each having an inductor;

wherein:

the inductor of each delay unit is coupled in series to a corresponding LED array of the LED arrays;

inductors coupled to different LED arrays have different inductances so that delay times associated with the delay units are different; and inductances of each of the inductors coupled to different LED arrays are configured so that each of the delay times associated with the delay units is shorter than a single period of driving time of the LED arrays, and configured so that a duration of time during which light emission does not substantially take place is eliminated from the light emitting device as a whole.

2. The light emitting device of claim 1, wherein each LED array includes at least one LED.

3. The light emitting device of claim 1, wherein at least one of the LED arrays is not coupled to a corresponding delay unit.

4. The light emitting device of claim 1, wherein each of the LED arrays includes the same number of LEDs.

5. The light emitting device of claim 1, wherein the power source includes:

an AC power source; and a rectifying unit coupled to the AC power source and configured to supply a rectified signal to the LED arrays.

6. The light emitting device of claim 5, wherein LEDs of the LED arrays are electrically connected in the same direction.

7. The light emitting device of claim 1, wherein:

the LED arrays include a plurality of sets of LED arrays; and each of the sets of LED arrays include a first LED array including LEDs electrically connected in a first direction and a second LED array including LEDs electrically connected in a second direction opposite the first direction.

8. The light emitting device of claim 7, wherein for at least one of the sets of LED arrays, the first LED array is coupled to a delay unit that is substantially similar to a delay unit coupled to the second LED array.

9. The light emitting device of claim 1, wherein the power source unit includes a driver integrated circuit (IC) coupled to the LED arrays.

10. A light emitting device, comprising:

a power source;

a plurality of light emitting diode (LED) arrays, each LED array including a plurality of LEDs;

a plurality of delay units, each having an inductor coupled in series to a corresponding LED array; and a driver integrated circuit (IC) coupled between the power source and the LED arrays;

wherein:

inductors coupled to different LED arrays have different inductances so that delay times associated with the delay units are different; and inductances of each of the inductors coupled to different LED arrays are configured so that each of the delay times associated with the delay units is shorter than a single period of driving time of the LED arrays, and configured so that a duration of time during which light emission does not substantially take place is eliminated from the light emitting device as a whole.

11. The light emitting device of claim 10, wherein the driver IC is coupled to each LED of the LED arrays and configurable to individually control each LED.

12. The light emitting device of claim 10, wherein LEDs of at least two of the LED arrays are electrically connected in opposite directions.

* * * * *